US008284015B1

(12) United States Patent
Van Eyck et al.

(10) Patent No.: US 8,284,015 B1
(45) Date of Patent: Oct. 9, 2012

(54) EASILY SANITIZED CONTROL DEVICE

(76) Inventors: Jerry J. Van Eyck, Mill Creek, WA (US); Richard A. Fine, Mercer Island, WA (US)

( * ) Notice: Subject to any disclaimer, the term of this patent is extended or adjusted under 35 U.S.C. 154(b) by 301 days.

(21) Appl. No.: 12/553,859

(22) Filed: Sep. 3, 2009

(51) Int. Cl.
*H01C 10/16* (2006.01)

(52) U.S. Cl. ..... 338/128; 335/207

(58) Field of Classification Search ..... 338/128, 338/125; 335/4, 5, 104, 205–207
See application file for complete search history.

(56) References Cited

U.S. PATENT DOCUMENTS 5,442,865 A * 8/1995 Wallrafen ..... 33/708
5,666,096 A * 9/1997 Van Zeeland ..... 335/4
5,867,082 A * 2/1999 Van Zeeland ..... 335/205
6,023,213 A * 2/2000 Van Zeeland ..... 335/205
* cited by examiner

*Primary Examiner* — Kyung Lee

(57) ABSTRACT

A smooth surface of a control device is achieved by positioning the actual control devices within a sealed housing and having the operator touchable knobs proximity connected to the control devices through the surface of the housing. In one embodiment, the proximity connection is a magnetic connection between the handle mechanism detachably positioned on the outside of the housing and traditional slider potentiometers mounted within the housing. In another embodiment, longitudinal proximity sensors within the housing are used to emulate the physical layout of the slider potentiometers and the movement of handle mechanisms outside the housing create the changing proximity under control of the operator. In all embodiments, the outside handle mechanism easily separates from the housing leaving a relatively smooth outer housing surface which can be easily sanitized. The removed handle mechanism allows for easy cleaning and sanitizing as well as for easy substitution.

13 Claims, 5 Drawing Sheets

EASILY SANITIZED CONTROL DEVICE

TECHNICAL FIELD

This disclosure is related to improved control devices and more particularly to such devices that allow for easy cleaning and sanitizing particularly for use in a medical environment.

BACKGROUND OF THE INVENTION

It is well known that when equipment is used in certain environments, such as in medical environments, it is important to be able to clean and/or sanitize the device from time to time. In some situations, it is important to be able to sanitize the device between patients.

Medical equipment often have control devises on the outside of the equipment and the knobs and handles of these devices present a cleaning and/or santizing problem. One such control, the time gain compensation (TGC) control, is an important aspect for ultrasonic scanners in that they allow a Sonographer to quickly adjust various portions of the image while the ultra sound examination is in progress. Slide potentiometers have been used as one method of adjusting the time/gain characteristics of an image. Such potentiometers, due to their open design, have the potential for allowing contaminating debris to enter the slide mechanism under the control grip (slider) and thus are not easily cleanable.

One approach to solving this problem has been to replace the slide potentiometers with rotary potentiometers each having a knob for turning a shaft to adjust the potentiometer setting. These rotary potentiometers are positioned behind a cleanable surface with only the shaft extending through the surface. The knob is then detachably coupled to the outer end of the rod and the knob can be removed so that the surface of the device can be cleaned. In addition to the fact that even using rotary potentiometers the shaft passes through the surface of the device requiring a sealing mechanism and a potential sanity failure, a human factors problem exists with rotary potentiometers.

This human factor problem is serious in that the slide potentiometers have gained favor among sonographers because the slides provide a tactile feel to the relative positions of the various potentiometers that control an image. This is important because sonographers prefer to keep their eyes focused on the patient during a procedure and the tactile feel of the various sliders allow them to know the current settings by feel (or with a quick glance) without requiring them to closely study the rotary dials.

BRIEF SUMMARY OF THE INVENTION

A smooth surface of a control device is achieved by positioning the actual control devices within a sealed housing and having the operator touchable knobs proximity connected to the control devices through the surface of the housing. In one embodiment, the proximity connection is a magnetic connection between the handle mechanism detachably positioned on the outside of the housing and traditional slider potentiometers mounted within the housing. In another embodiment, longitudinal proximity sensors within the housing are used to emulate the physical layout of the slider potentiometers and the movement of handle mechanisms outside the housing create the changing proximity under control of the operator. In all embodiments, the outside handle mechanism easily separates from the housing leaving a relatively smooth outer housing surface which can be easily sanitized. The removed handle mechanism allows for easy cleaning and sanitizing as well as for easy substitution.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
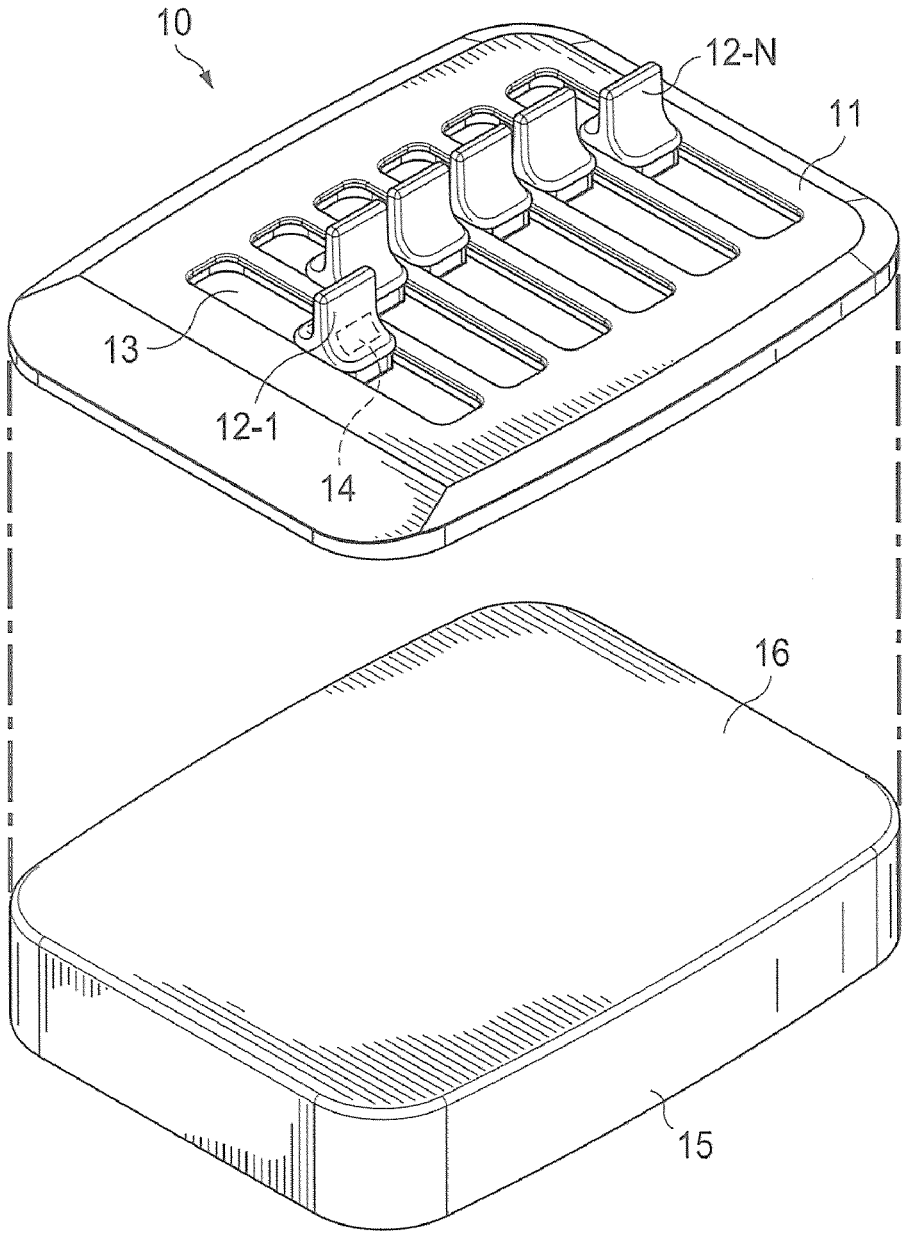
FIG. 1 shows a perspective side view of one embodiment of a removable handle mechanism shown detached from the electrical control housing.
Figure 4:
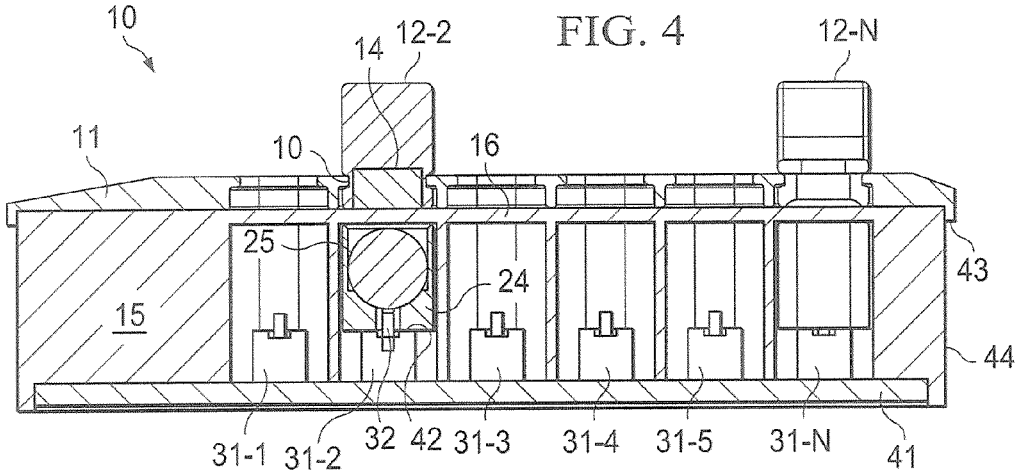
FIG. 4 shows a side cross-section view of one example embodiment with the removable handle mechanism attached to the control mechanism and using a magnetic interface between the two devices.

FIG. 1 shows a perspective side view of one embodiment 10 of removable handle mechanism 11 detached from electrical control mechanism 15. Electrical control mechanism 15 is shown with electrical control mechanism cover 16 in place. Removable handle mechanism 11, having slider controls 12-1 through 12-N therein, combines with electrical control mechanism 15, including electrical control mechanism cover 16, to create control device 10. Slider controls 12-1 through 12-N are for illustrative purposes and can be in many shapes, materials, and sizes. The actual electrical control devices are located inside mechanism 15. Slider controls 12-1 through 12-N each have a range of motion that is restricted by track well 13. Track 45, shown in FIG. 4, is used inside well 13 to prevent slider controls 12-1 through 12-N from coming out of the well. Note that while FIG. 1 shows removable handle mechanism 11 covering the entire device 15, the concepts discussed herein could be used such that housing 11 covers only a portion of a larger control surface.

Figure 2:
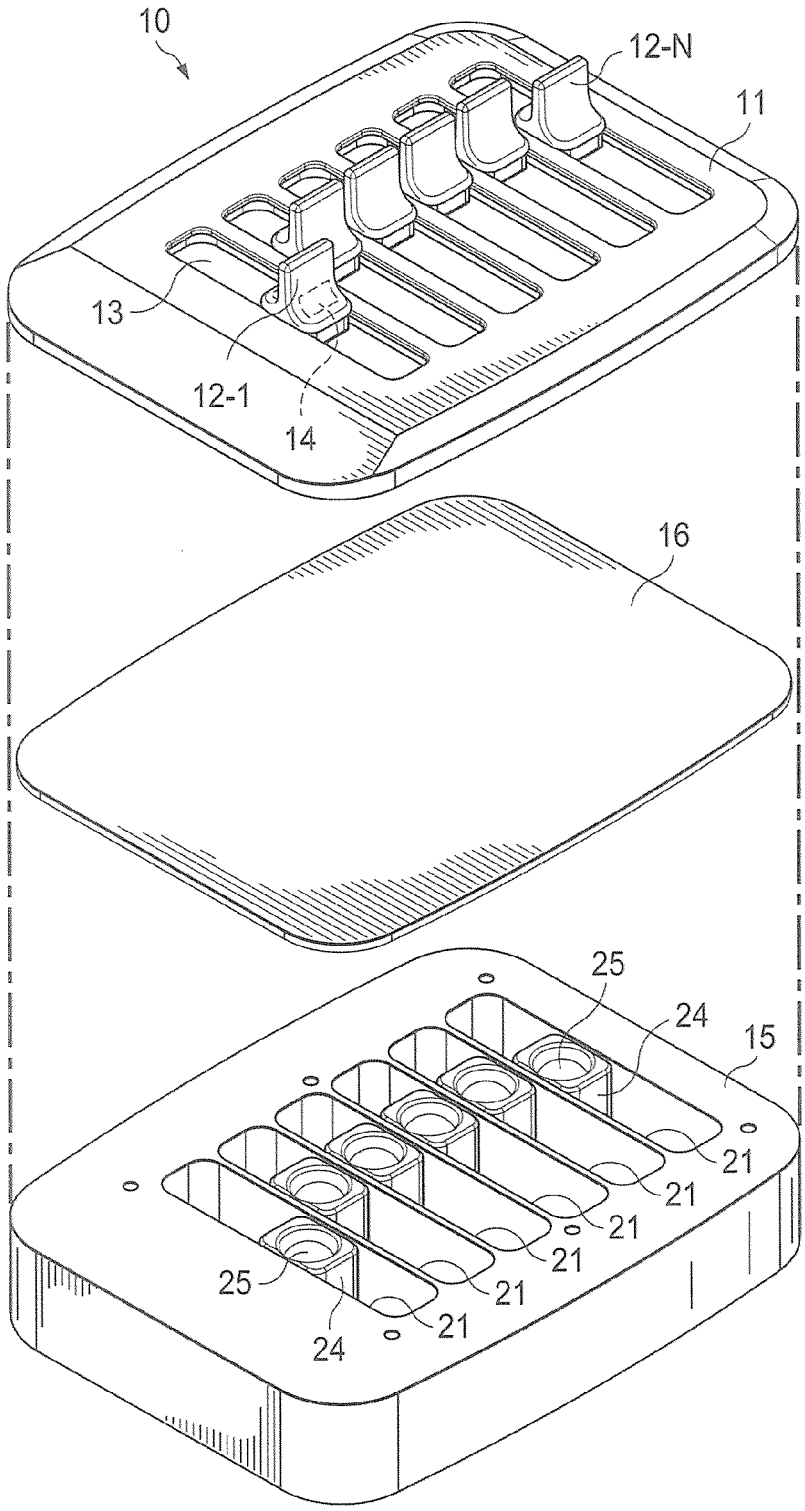
FIG. 2 shows a perspective side view of the removable handle mechanism as well as a top cover of the electrical control mechanism shown detached from the housing mechanism enabling an internal view of an example embodiment of the internal control mechanism using a magnetic interface with the removable handle mechanism.

FIG. 2 shows a perspective side view of removable handle mechanism 11 and electrical control mechanism cover 16 detached from electrical control mechanism 15. Note that the invention might not need a detachable electrical control mechanism cover and that the diagram is for illustrative purposes. Inside the electrical control mechanism are wells 21 that give the range of motion for slide potentiometers control housing 24. FIG. 2 illustrates one embodiment 10 wherein the slide potentiometer (not seen in FIG. 2) is attached to a bottom surface of slide potentiometer control housing 24. In the embodiment shown, housing 24 has a spherical metallic object 25 inside of it. The purpose of spherical metallic object 25 is to provide a means to control slide potentiometer control housing 24 via a magnetic interface with lever 12-1.

Figure 3:
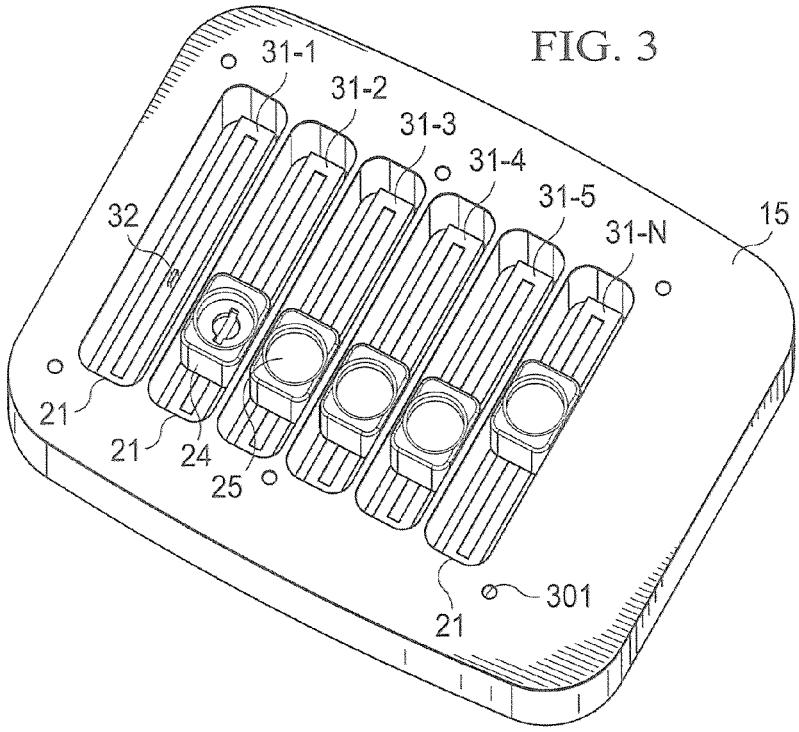
FIG. 3 shows a perspective top internal view of an example embodiment of the control mechanism using a magnetic interface with the removable handle mechanism.

FIG. 3 shows a perspective top internal view of electrical control mechanism 15. Inside each electrical control mechanism well 21 is a slide potentiometer 31-1 to 31-N. Each slide potentiometer has a handle 32 that is moved longitudinally along the slide potentiometer to control the resistance of the potentiometer. Each slide potentiometer is fitted with slide potentiometer control housing 24 (shown with respect to potentiometer 31-2 to 31-N but absent with respect to potentiometer 31-1) to control the location of each slide potentiometer handle 32. Slide potentiometer handle 32 is the mechanism by which a user controls a slide potentiometer, for example, to adjust time/gain characteristics of an image on an ultrasonic scanner. In this embodiment, spherical metallic object 25 is placed on slide potentiometer control housing 24. For clarity in the illustration, FIG. 3 displays slide potentiometer 31-1 alone with slide potentiometer handle 32; slide potentiometer 31-2 with control housing 24 without spherical metallic object 25; and slide potentiometer 31-3 with housing 24 having spherical metallic object 25 therein.

FIG. 4 shows the internal cross-section view of the invention in one particular embodiment. For clarity of the illustration, FIG. 4 only shows a few of the slider controls, including an illustration of the device without the slider in some of the wells, a cutaway illustration for slide potentiometer 31-2 to show the cross-section of the entire slider control mechanism, and a slider control connected magnetically to a slide potentiometer control housing for slide potentiometer 31-N. The control device in FIG. 4 uses magnet 14 placed inside the slider controls to engage the respective spherical balls within housing 24. In this embodiment, a magnet would be placed in all the slider controls, but for illustrative purposes, FIG. 4 only displays two slider controls.

Magnet 14 is able to control slide potentiometer control housing 24 using the magnetic connection between magnet 14 outside the control housing and spherical metallic object 25 within the housing. Using magnetic force, slider control 12-2 is able to control slide potentiometer control housing 24, thereby adjusting slide potentiometer 31-2 via slide potentiometer handle 32. Other embodiments could invert the location of the magnet and the metallic object, and/or have a different shaped metallic object. Other embodiments could use different techniques other than magnetic force to control slide potentiometers 31-1 through 31-N. Removable mechanism 11 is fitted to the electrical control mechanism 15 by snapping (or attached by some other means) edge 43 of the removable mechanism over side 44 of the electrical control mechanism. Because mechanism 11 is easily detachable from housing 15, the equipment is able to be sanitized without opening electrical control mechanism 15. The use of spherical metallic device within housing 24 serves to not only facilitate good magnetic coupling but reduces friction by allowing the ball to roll on the under surface of cover 16.

Figure 5:
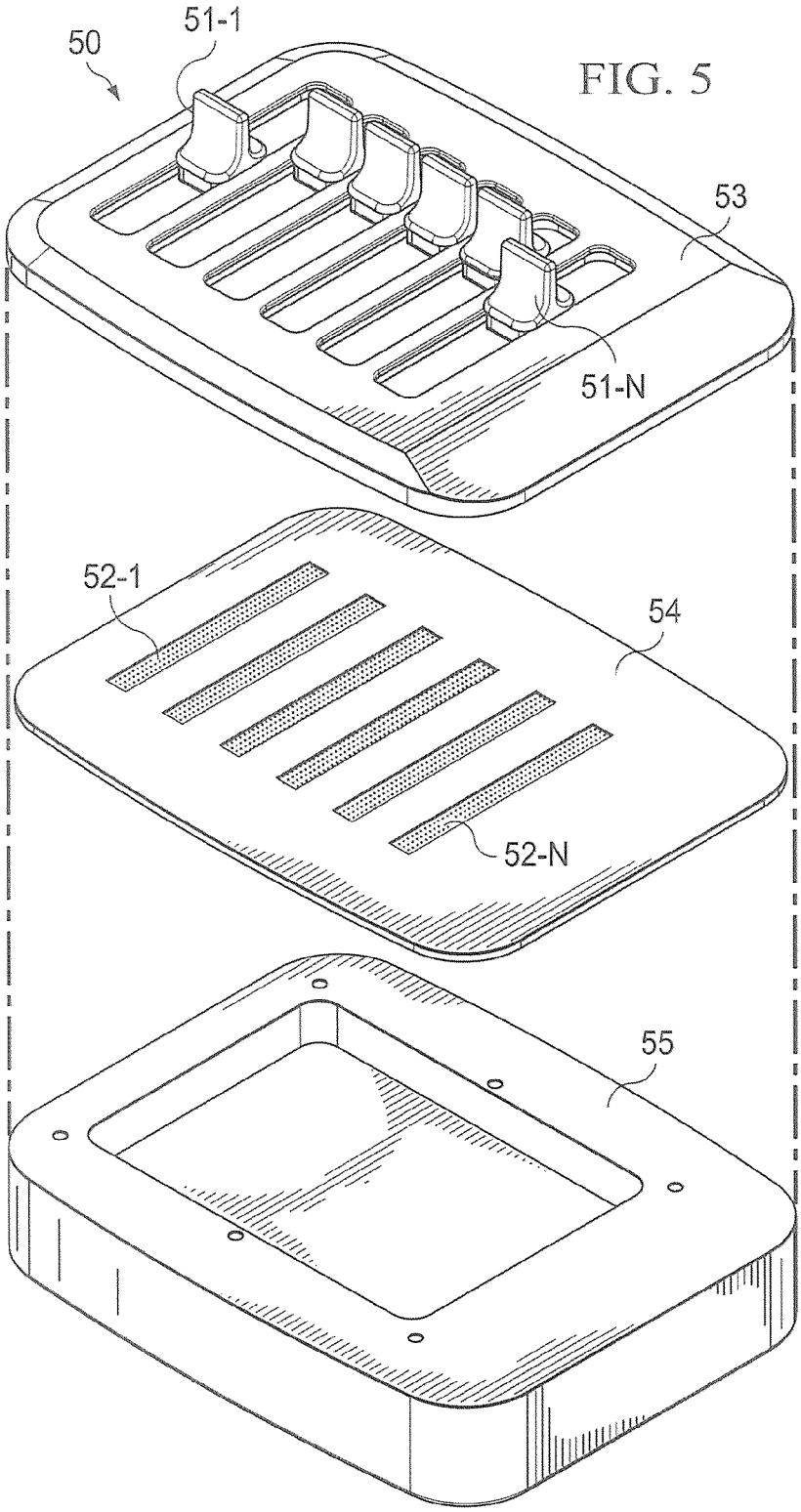
FIG. 5 shows a side perspective view of an alternative embodiment of the removable handle mechanism attached to the control mechanism; and using longitudinal proximity sensors.

FIG. 5 shows a perspective side view of an alternate embodiment using longitudinal proximity sensors to control the potentiometer. Removable handle mechanism 53 interacts with electrical control mechanism cover 54 having wells 52-1 through 52-N therein. Wells 52-1 to 52-N contain proximity detector strips reactive to the position of each handle 51-1 to 51-N.

Figure 6:
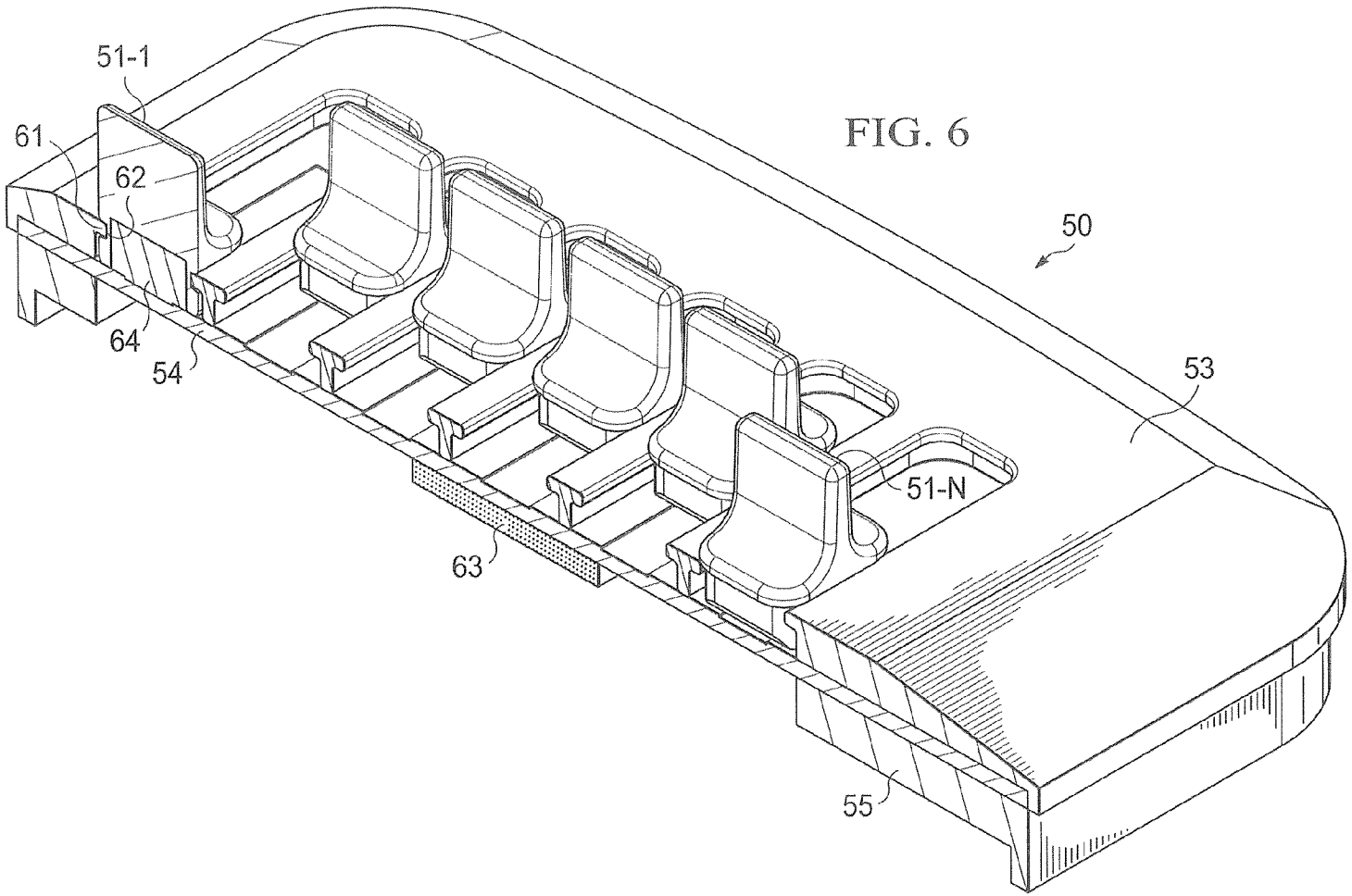
FIG. 6 shows a side perspective view of another example embodiment with the removable handle mechanism attached to the control mechanism using longitudinal proximity sensors to interface between the two devices.

FIG. 6 shows a cross-section view of control device 50 from a perspective side view. Slider 51-1 controls the tag or event control component 64. Sensor 63 (only a portion shown) detects the movement of slider 51-1 along track and groove 61-62. In this illustration, sensor 63 is shown placed underneath a single slider. This is for illustrative purposes and there would be multiple sensors, one for each slider or one for multiple sliders. Slider 51-1 is held into place by a protruded edge 62 against track 61 designed to prevent slider 51-1 from coming out of the well. Sensor 63 is able to provide the information to the control device to adjust the slide potentiometer or other TGC controller. Because removable handle mechanism 50 is detachable, the equipment is able to be sanitized without opening electrical control mechanism 55 in the manner discussed above.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A switch device for use in a clean environment, said device comprising:

a housing having a smooth surface;

at least one switch mechanism mounted within said housing;

a detachable housing mountable over said smooth surface, said housing containing a same number of operator adjustable handles as there are switch mechanisms mounted within said housing; and a proximity coupling for each said handle for coupling each said handle to a specific one of said switch mechanisms without making actual physical contact between said handles and said switch mechanisms.

2. The switch of claim 1 wherein said proximity coupling comprises an individual magnet for each said switch mechanism.

3. The switch device of claim 2 wherein said switch mechanism is a longitudinal slide potentiometer.

4. The switch device of claim 3 wherein each said magnet creates said proximity coupling by attracting a magnetic responsive material across said smooth surface.

5. The switch device of claim 4 wherein said magnetic responsive material is spherical.

6. The switch device of claim 1 wherein said switch mechanism is a longitudinal proximity sensor.

7. The switch of claim 6 wherein said detachable housing is shaped to mate with a structure of said housing and wherein said detachable housing has longitudinal slots therein each said slot having a captive handle positioned therein, said slots positioned to be lined up with said longitudinal switch mechanisms when said detachable housing and said sealed housing are mated.

8. A housing for use in conjunction with a sealed control system, said sealed system having at least one easily cleanable smooth outer surface, said housing comprising:

a structure for temporary attachment to a solid surface, said structure comprising:

at least one operator adjustable handle permanently retained by said structure, said handle coming into proximity with an electrical control device positioned within said sealed control system when said structure is temporarily attached to said solid surface, said proximity of said handle to said control device allowing an operator to adjust said control device by manipulating said handle without actual physical contact between said handle and said control device.

9. The housing of claim 8 wherein said proximity comprises a magnetic connection between said handle and said control device, said magnetic connection extending through said outer surface of said control system.

10. The housing of claim 9 wherein said magnetic coupling comprises at least one magnet within said handle and a corresponding magnetic receptor in physical contact with a movable portion of said control device.

11. The housing of claim 10 wherein said at least one receptor is spherical.

12. The housing of claim 9 wherein said control device is an elongated slide potentiometer.

13. The housing of claim 9 having a plurality of handles and wherein said structure comprises a series of spaced apart elongated slots such that one of said handles is retained within each said elongated slot, each said slot being aligned with an individual one of said elongated control devices within said sealed control system.

* * * * *